US007815192B1

(12) United States Patent
Kreiman et al.

(10) Patent No.: US 7,815,192 B1
(45) Date of Patent: Oct. 19, 2010

(54) MILITARY TARGET SYSTEM

(75) Inventors: Kerry L. Kreiman, Knoxville, TN (US); Mark C. Englert, Stockbridge, GA (US); William R. Brown, Jr., Lenoir City, TN (US); Donald Ray Buttrey, Knoxville, TN (US); Matthew G. Hughs, Knoxville, TN (US)

(73) Assignee: EOD Technology, Inc., Lenoir City, TN (US)

( * ) Notice: Subject to any disclaimer, the term of this patent is extended or adjusted under 35 U.S.C. 154(b) by 0 days.

(21) Appl. No.: 12/496,765

(22) Filed: Jul. 2, 2009

(51) Int. Cl.
*F41J 5/14* (2006.01)

(52) U.S. Cl. ..... 273/390

(58) Field of Classification Search ..... 273/386–392, 273/403–410
See application file for complete search history.

(56) References Cited

U.S. PATENT DOCUMENTS 675,804 A * 6/1901 Tyrell ..... 273/392
884,663 A 4/1908 Johnston et al.
1,317,556 A * 9/1919 Cooper ..... 273/367
1,424,632 A 8/1922 Fenton
1,537,738 A * 5/1925 Bisbing ..... 273/390
2,967,712 A * 1/1961 Breitenfeldt ..... 273/388
3,979,118 A * 9/1976 Saunders et al. ..... 273/388
4,052,058 A 10/1977 Hintz
4,119,317 A * 10/1978 Ohlund et al. ..... 273/406
4,283,060 A 8/1981 Braunschweiler
4,373,733 A * 2/1983 Smith, Jr. ..... 273/381
4,401,303 A 8/1983 Anderson et al.
4,501,427 A 2/1985 Payne
4,691,925 A 9/1987 Scholem
4,726,593 A 2/1988 Wade
5,176,386 A 1/1993 Simmons
5,277,432 A 1/1994 Bateman
6,398,215 B1 6/2002 Carroll
6,478,301 B1 11/2002 Witmeyer
6,994,348 B2 2/2006 Lambert et al.
6,994,349 B2 2/2006 Lambert et al.
7,114,725 B2 10/2006 Camp et al.
7,134,977 B2 * 11/2006 Campbell et al. ..... 473/454
7,201,376 B2 4/2007 Kuosa
7,690,656 B2 * 4/2010 Saunders ..... 273/392
2006/0240388 A1 10/2006 Marshall et al.
2010/0140874 A1 * 6/2010 Kobett ..... 273/407

* cited by examiner

*Primary Examiner*—Mark S Graham
(74) *Attorney, Agent, or Firm*—Luedeka, Neely & Graham, PC

(57) ABSTRACT

A target system having a base, a stationary member inclined from the base and having a cap, a rotating tube having a cap and positioned over the stationary tube, a bearing between the caps of the stationary member and the rotating tube to permit substantially free rotation of the rotating tube, and a plurality of target sides secured to the rotating tube, with impact of a fired round onto one of the target sides initiating movement of the rotating tube relative to the stationary member.

9 Claims, 5 Drawing Sheets

MILITARY TARGET SYSTEM

FIELD

This disclosure relates to the field of targets for military target ranges. More particularly, this disclosure relates to a portable target that is durable, moves accurately when hit by a fired round, and does not require resetting after impact of a fired round.

BACKGROUND

Improvement is desired in the field of targets of the type used to train military personnel in heavy caliber weapons, such as 7.62 mm and .50 caliber rounds, and other common training rounds, such as 40 mm training practice (TP) rounds, 40 mm high explosives (HE) rounds, 20 mm cannon TP, HE, and 25 mm TP and HE rounds. Typically, such rounds are fired by heavy machine gun systems, which systems are often mounted on rotary and fixed wing gunship type aircraft.

Disadvantages associated with conventional targets include a lack of durability which leads to heavy maintenance costs and difficulty in observation of hits on the target. Attempts to provide targets on which hits may be observed typically disadvantageously results in targets that must be re-set or replaced after the hit.

The present disclosure advantageously provides configured to withstand repeated hits from military rounds, moves in response to a hit to indicate that a fired round has hit the target; and is immediately ready without the need to be reset.

SUMMARY

The above and other needs are met by portable military target system for being impacted by military rounds fired by a military weapon.

In one aspect, the system includes a base and a stationary member having a length and fixedly secured to the base and extending upwardly therefrom. A rotating member is positioned over the stationary member and has a length that is less than the length of the stationary member.

A bearing is located between the stationary member and the rotating member to permit substantially free rotation of the rotating member relative to the stationary member. A plurality of target sides are spaced apart around and fixedly secured to the rotating member in an outwardly extending orientation so as to promote rotational movement of the rotating member when hit by a fired round.

Side shields are secured to adjacent ones of the target sides. The side shields are provided by elongate rectangles of a length to substantially cover the rotating member without interfering with rotation thereof, and of a width to contact adjacent ones of the target sides close to the rotating member, but slightly spaced from the rotating member to substantially shield the rotating member from being hit by rounds.

The target systems are configured to withstand repeated hits from military rounds, and move in response to a hit to indicate that a fired round has directly hit the target sides. A further advantage is provided in that the target systems are immediately ready to receive further fire without the need to be reset.

In another aspect, the disclosure relates to a base, a stationary member inclined from the base and having a cap, a rotating tube having a cap and positioned over the stationary tube, a bearing between the caps of the stationary member and the rotating tube to permit substantially free rotation of the rotating tube, and a plurality of target sides secured to the rotating tube, with impact of a fired round onto one of the target sides initiating movement of the rotating tube relative to the stationary member.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
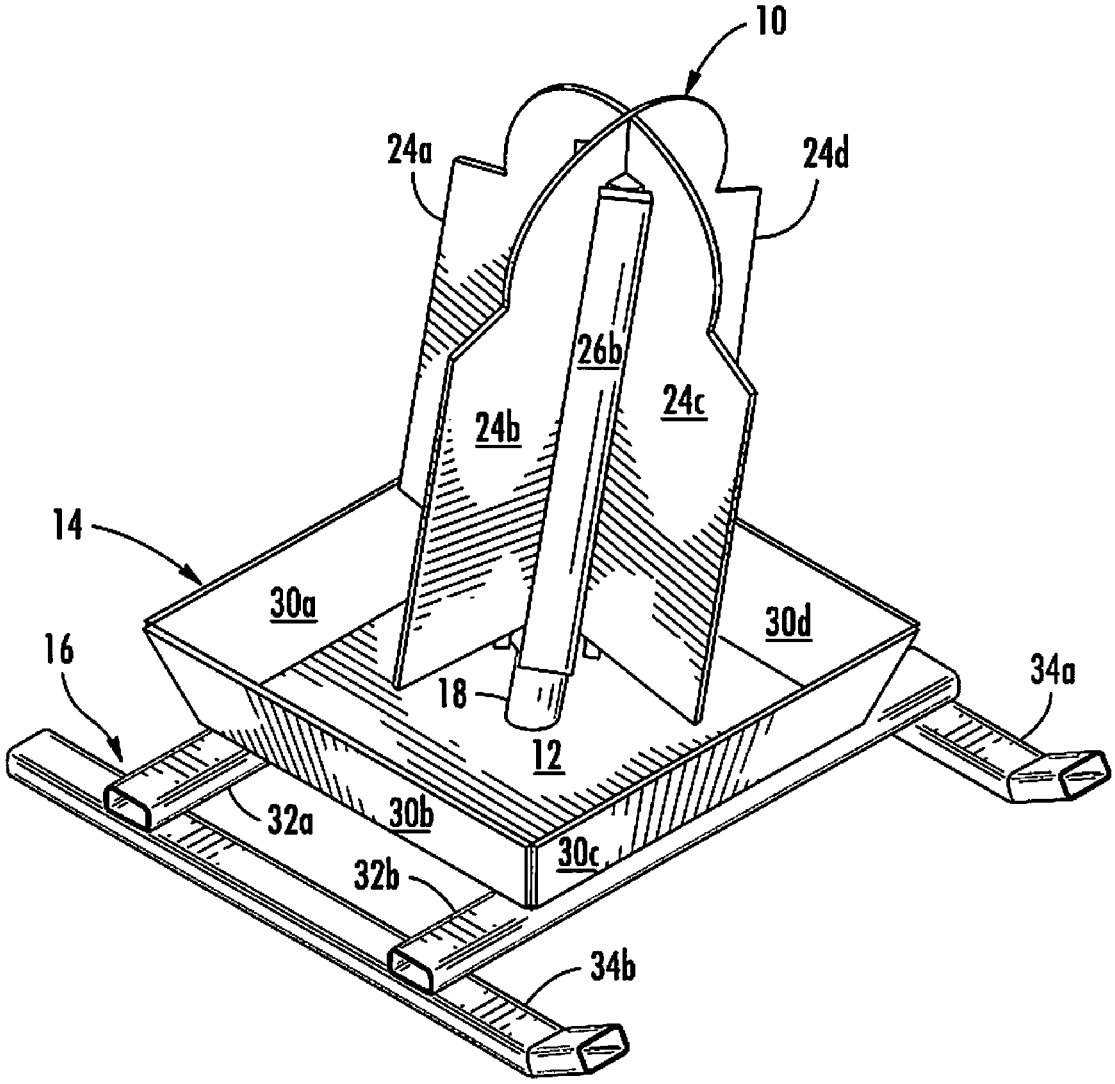
FIG. 1 is a perspective view of a target system according to the disclosure.
Figure 2:
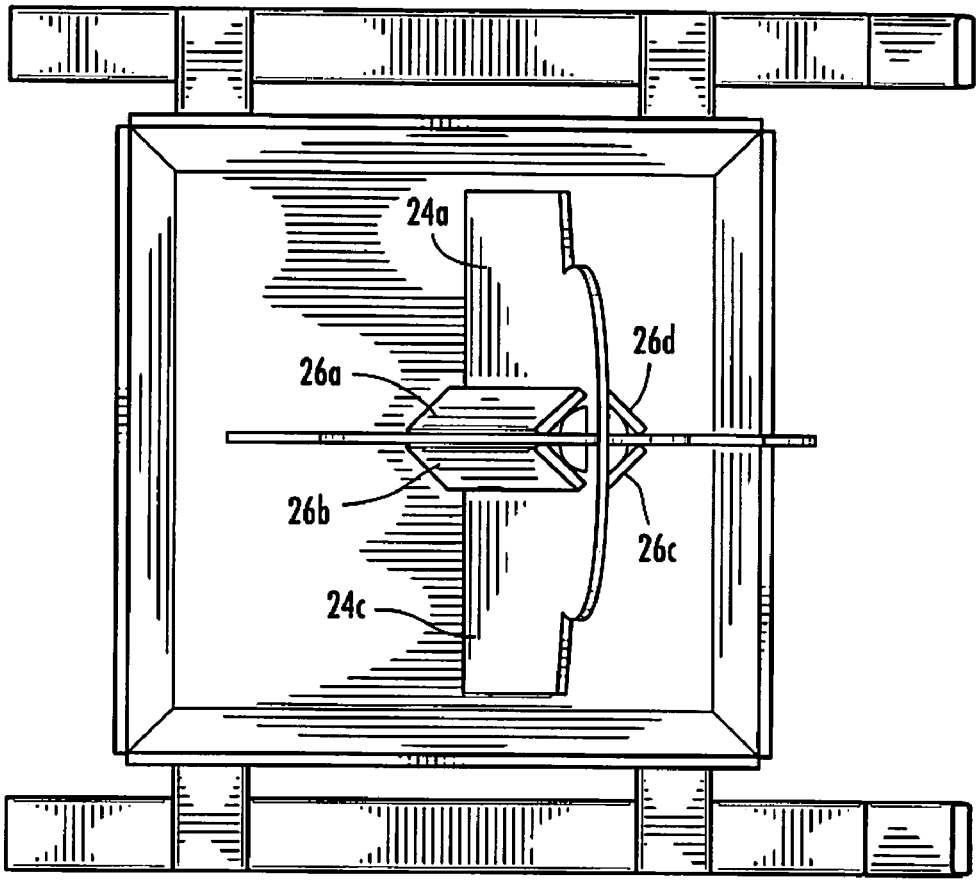
FIG. 2 is a top view of the target system of FIG. 1.

With reference to the drawings, the disclosure relates to a military target system 10 configured to withstand repeated hits from military rounds, that moves in response to a hit to indicate that a fired round has impacted the target; and is immediately ready without the need to be reset.

The target system 10 includes a base 12 having a base shield 14, a transport sled 16, a stationary tube 18 rising from the center of the base 12, a target mount tube 20 sized to slide over the stationary tube 18 and to rotate relative thereto, a bearing 22 located at the top of the stationary tube 18 for permitting rotation of the target mount tube 20, a plurality of target sides 24*a*, 24*b*, 24*c*, and 24*d* extending from the target mount tube 20, and side shields 26*a*, 26*b*, 26*c*, and 26*d* between the target sides 24*a*-24*d* to shield the target mount tube 20 from damage.

The components of the target system 10 may be made of a durable material such as hardened steel plate, with the components welded for assembly. Suitable steel materials include one-half inch AR500 hardened steel plate and one inch A36 steel plate. The targets are compact and easily transported by dragging or by a forklift. In addition, the targets are devoid of any non-recyclable materials and may be readily recycled at the end of their life.

The base 12 is provided as by a flat steel plate and the base shield 14 is provided as by peripheral outwardly angled sidewalls 30*a*-30*d* extending upwardly from the periphery of the base 12. The sidewalls 30*a*-30*d* are configured to provide a shield structure to protect lower portions of the target structure from impact from military rounds, with the angle of the sidewalls deflecting rounds away from the target. In addition, the tub-like structure provided by the base 12 and sidewalls 30*a*-30*d* readily accepts sandbags, concrete, dirt or the like if additional weight is desired. Drainage holes may be provided through the base 12.

The transport sled 16 may be utilized to enhance portability of the target system 10. The sled 16 may be provided as by a pair of cross members 32*a* and 32*b* welded to the lower surface of the base 12, with a pair of runners 34*a* and 34*b* oriented perpendicular to the cross members 32*a* and 32*b* and welded thereto.

Figure 3:
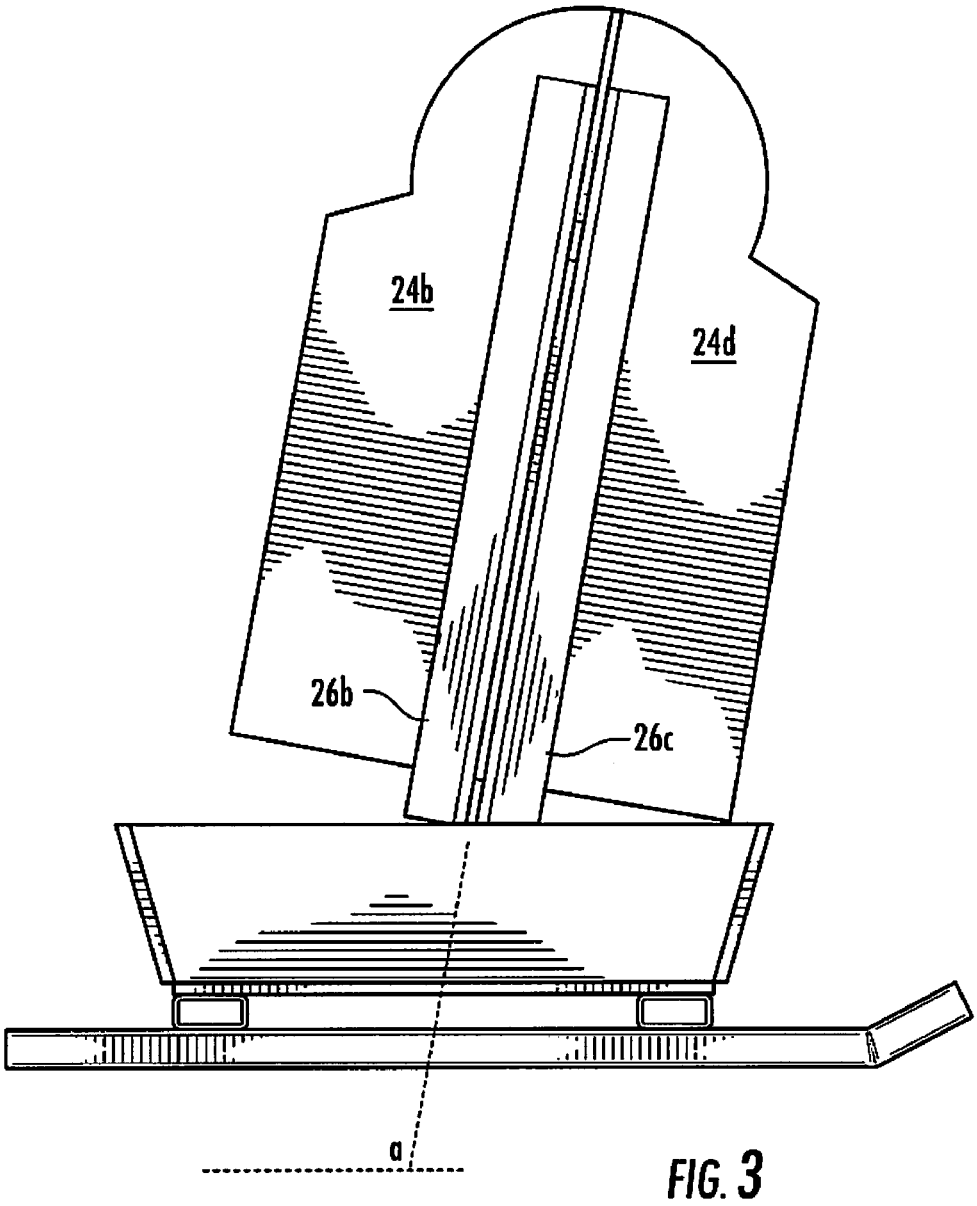
FIG. 3 is a side view of the target system of FIG. 1.
Figure 4:
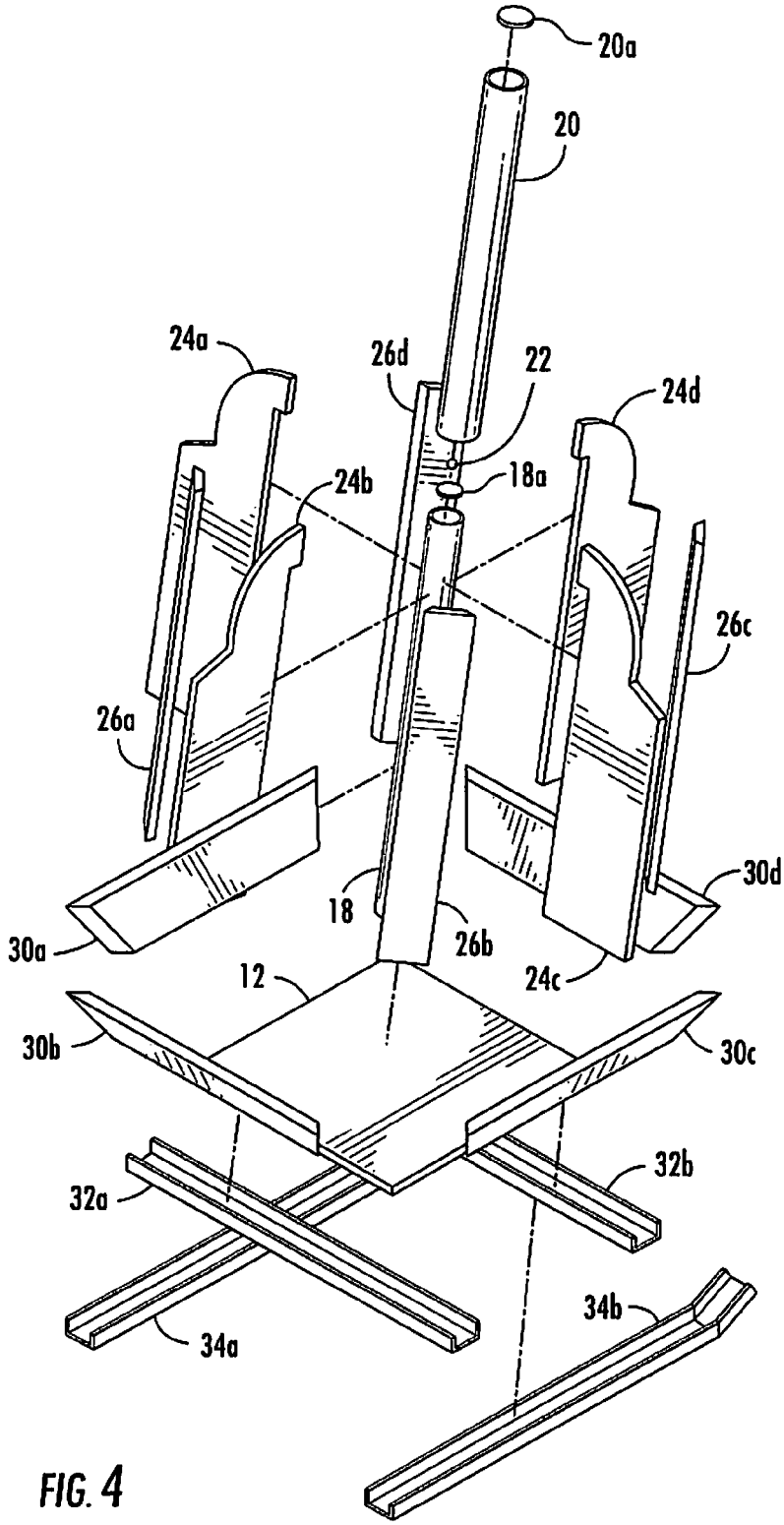
FIG. 4 is an exploded perspective view of the target system of FIG. 1.
Figure 5:
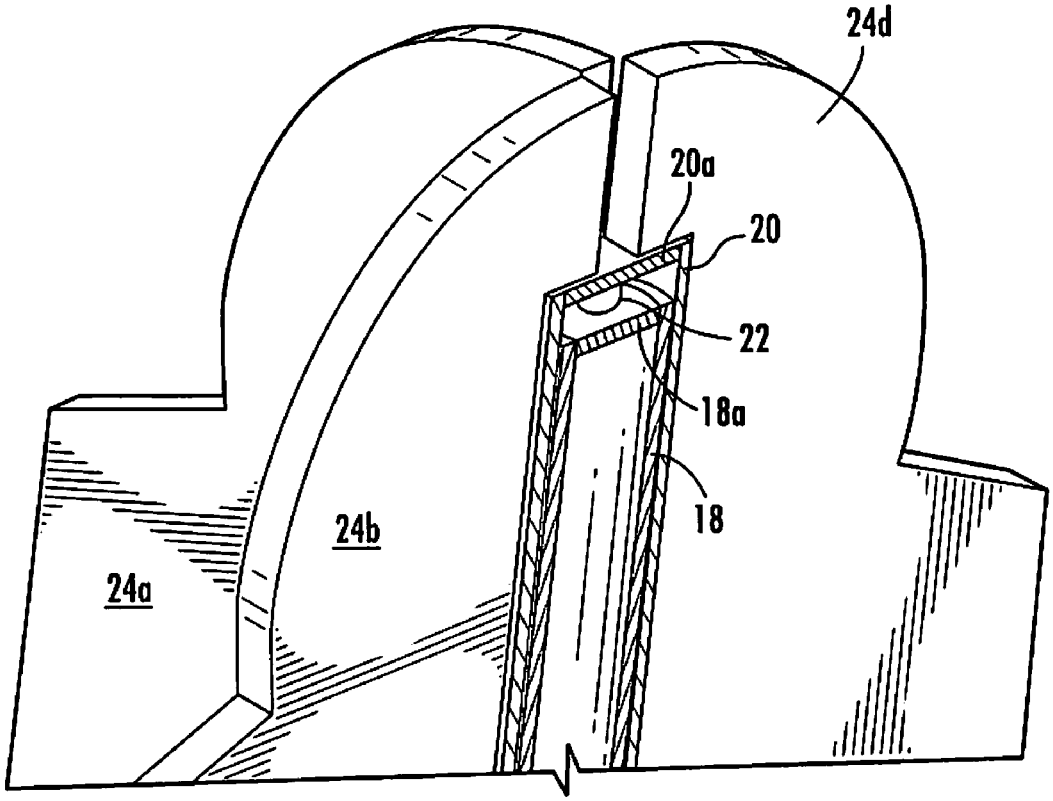
FIG. 5 is a close-up view of interior portions of the target system of FIG. 1.

The stationary tube 18 is an elongate cylinder welded to a central location of the base 12, having a cap 18*a* welded onto its upper end. The end of the tube 18 that is welded to the base 12 is cut at an angle so that the tube 18 extends upwardly at an angle a (FIG. 3) that is greater than 90 degrees, so as to be inclined from vertical. A preferred angle is 100 degrees (from horizontal) so that the tube 18 is canted 10 degrees from vertical. The orientation of the tube 18 as described renders the target sides' 24*a*-24*d* also at the same orientation which is advantageous to enable the range officer positioning the target system the option of desirably directing the ricochet of rounds. For example, rounds striking from the direction of incline will be directed downwardly into the ground. Conversely, rounds striking from the opposite direction will be directed deeper into the impact area. In addition, it has been observed that the angle also aids in improving visibility of the target systems from the air.

The target mount tube 20 is configured as an elongate cylinder sized to slide over the stationary tube 18 and to rotate relative thereto. The tube 20 is shorter than the tube 18. A cap 20*a* is welded onto the upper end of the tube 20 and positioned to be adjacent the cap 18*a*, with the bearing 22 located between and bearing against the caps 18*a* and 20*a* when the target mount tube 20 is positioned over the stationary tube 18 to permit substantially free rotation of the tube 20 relative to the stationary tube 18. The bearing 22 may be a ball bearing.

The target sides 24*a*-24*d* are shaped in a desired manner and welded to the target mount tube 20 and the cap 20*a*, preferably uniformly spaced apart to extend outwardly from the tube 20. The upper portions of the sides' 24*a*-24*d* which are configured to engage the cap 20 substantially protect the cap 20 from being hit by rounds. The sides' 24*a*-24*d* have a length substantially corresponding to, but slightly longer than, the length of the target mount tube 20. The side shields 26*a*-26*d* are secured to adjacent ones of the sides' 24*a*-24*d* by welding and are provided by elongate rectangles of a length to substantially cover the target mount tube 20 without interfering with rotation, and of a width to contact adjacent ones of the sides' 24*a*-24*d* close to the tube 20, but slightly spaced from the tube 20. As will be appreciated, the shields 26*a*-26*d* substantially prevents rounds from hitting the tube 20.

The sides' 24*a*-24*d* are configured as shown in the drawings to resemble the shape of a human. In one manner of use, a plurality of the systems 10 are arranged on a military target range in groups to resemble anticipated enemy tactical formations. Trainees, such as gunners and assistant gunners, equipped with machine guns or other direct fire weapon systems utilize rotary of fixed winged gunships to learn the art of searching and traversing with a machine gun or other direct fire weapon systems. The target systems provide the gunner and assistant gunner instantaneous audible and visual indication of direct hits to the target.

In this regard, it will be appreciated that the outwardly extending orientation of the sides' 24*a*-24*d* from tube 20 promotes rotational movement when hit, with a "direct hit" being understood to refer to a fired round hitting one of the sides 24*a*-24*d*. A round that hits one of the shields 26*a*-26*d* or other parts of the target system 10 will not tend to impart such a rotational movement of the tube 20 relative to the tube 18.

The spinning motion or movement of the target systems when directly hit advantageously indicate a direct hit, with the sound of the round hitting the target also providing an audible indication. The transfer of energy from the round into movement also reduces damage to the target systems from the rounds. Also, the target systems do not tip-over or experience any change that requires manipulation for subsequent use as a target, and are ready to receive fire even if still spinning from a prior hit.

Accordingly, it will be appreciated that the target systems described herein are sufficiently durable to withstand repeated hits from military rounds, move in response to hits; and are immediately ready without the need to be reset.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed:

1. A portable military target system to withstand impact by military rounds fired by a military weapon, the system comprising:

a base;

a stationary member having a length and fixedly secured to the base and extending upwardly therefrom;

a rotating member positioned over the stationary member and having a length that is less than the length of the stationary member;

a bearing located between the stationary member and the rotating member to permit substantially free rotation of the rotating member relative to the stationary member;

a plurality of target sides spaced apart around and fixedly secured to the rotating member in an outwardly extending orientation outwardly extending orientation so as to promote rotational movement of the rotating member when hit by a fired round; and a plurality of side shields, each one of the side shields being secured to adjacent ones of the target sides and provided by elongate rectangles of a length to substantially cover the rotating member without interfering with rotation thereof, and of a width to contact adjacent ones of the target sides close to the rotating member, but slightly spaced from the rotating member to substantially shield the rotating member from being hit by rounds.

2. The system of claim 1, further comprising a plurality of peripheral sidewalls extending upwardly and outwardly from the periphery of the base and configured to provide a shield structure to protect lower portions of the target system from impact from military rounds, with the angle of the sidewalls deflecting rounds away from the target system.

3. The system of claim 1, further comprising a sled secured to the base for facilitating relocation of the target system.

4. The system of claim 1, wherein the stationary member is inclined relative to the base so as to lean relative to vertical.

5. The system of claim 1, wherein the stationary member is inclined at an angle of about 10 degrees relative to vertical.

6. The system of claim 1, wherein the stationary member comprises a tube.

7. The system of claim 1, wherein the rotating member comprises a tube.

8. The system of claim 1, wherein the target sides have a length substantially corresponding to, but slightly longer than, the length of the rotating member.

9. The system of claim 1, wherein the target sides are configured to resemble a human shape.

* * * * *